United States Patent [19]

Garza et al.

[11] Patent Number: 4,560,363

[45] Date of Patent: Dec. 24, 1985

[54] EYE-MOVING MECHANISM FOR A FIGURE TOY

[75] Inventors: Richard G. Garza, Paramount; Pinhas Sayegh; James R. Bjorklund, both of Los Angeles, all of Calif.

[73] Assignee: RCA Corporation, Princeton, N.J.

[21] Appl. No.: 567,465

[22] Filed: Jan. 3, 1984

[51] Int. Cl.[4] ..... A63H 3/38

[52] U.S. Cl. ..... 446/342; 446/351

[58] Field of Search ..... 446/301, 337, 339–345, 446/347–351, 353; 40/416, 425

[56] References Cited

U.S. PATENT DOCUMENTS

| | | | |
|---|---|---|---|
| 1,008,471 | 11/1981 | Jacquerod | 446/348 |
| 1,280,055 | 9/1918 | McCroskey | 446/347 |
| 1,545,077 | 7/1925 | Wilkins | 446/342 |
| 2,013,569 | 9/1935 | Manning | 446/337 |
| 2,604,730 | 7/1952 | Weiss | 40/416 |
| 2,706,364 | 4/1955 | Yakooleff | 446/343 |
| 3,421,255 | 2/1966 | Brudney | 446/343 |
| 3,550,315 | 12/1970 | Samo | 446/343 |
| 3,636,653 | 1/1972 | Gardel et al. | 446/303 |
| 3,699,707 | 10/1972 | Sapkus | 446/343 |
| 4,033,071 | 6/1977 | Strongin et al. | 446/177 |
| 4,074,460 | 2/1978 | Thorn et al. | 446/343 |
| 4,304,063 | 12/1981 | Katzman et al. | 446/183 |

FOREIGN PATENT DOCUMENTS

| | | | |
|---|---|---|---|
| 32937 | 9/1885 | Fed. Rep. of Germany | 446/345 |

*Primary Examiner*—F. Barry Shay

*Attorney, Agent, or Firm*—E. M. Whitacre; D. H. Irlbeck; L. L. Hallacher

[57] ABSTRACT

An animated figure toy (10) includes a head (14) in which a pendulum (26) is swingably mounted for reciprocating a cam follower (48) to blink eyelids (60, 62) and simultaneously move eyeballs (68, 70) from side to side.

1 Claim, 4 Drawing Figures

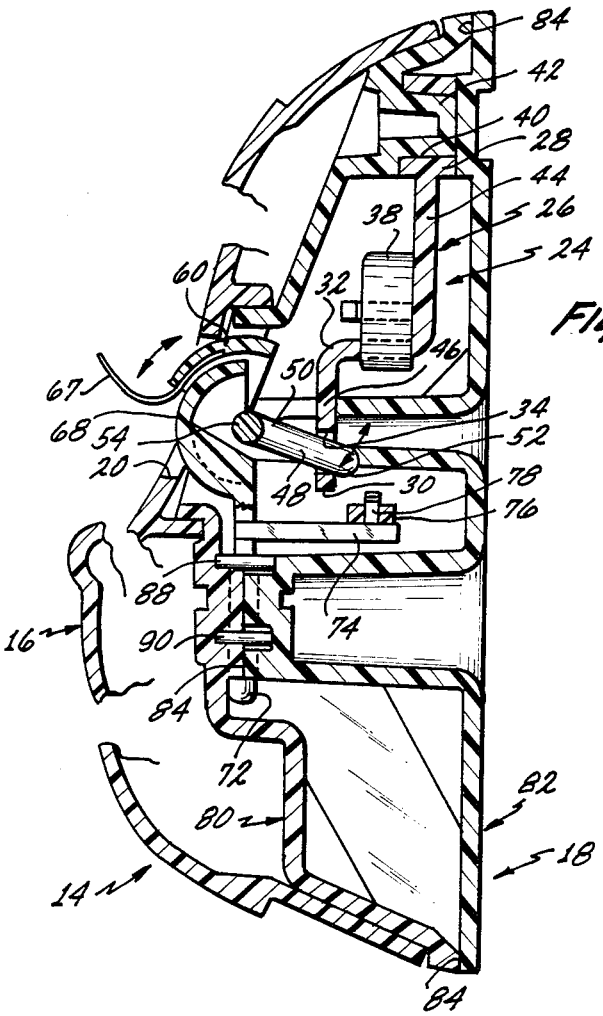
Fig. 2
Fig. 4
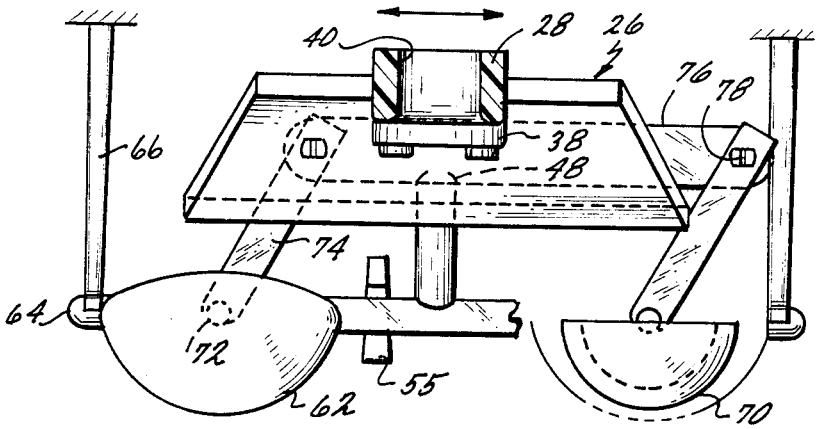

EYE-MOVING MECHANISM FOR A FIGURE TOY

TECHNICAL FIELD

The present invention relates to animated figure toys and, more particularly, to a new and useful animated figure toy having an improved eye-moving mechanism.

BACKGROUND ART

The prior art, U.S. Pat. No. 1,008,471, discloses a figure toy having eyes which are capable both of the ordinary opening and closing movement and of moving laterally.

Additionally, U.S. Pat. No. 2,706,364 discloses an eye-set for dolls which has a sleeping and rolling effect.

U.S. Pat. No. 3,421,255 discloses doll eyes that roll or swivel from left to right when the doll head is swung or rotated on a generally vertical axis, wherein motion is induced by weighting of pivotal eyeballs. A pair of rotative eyeballs are linked for effecting synchronized motion.

U.S. Pat. No. 3,550,315 discloses a doll eye assembly in which an eye member is pivotally mounted in a housing in a manner, and the weight of which is distributed with reference to its pivotal mounting, such that the eye member moves sideways and from side to side in the eye assembly when a doll head containing the eye member is tilted in upright position or is rotated when in supine position.

U.S. Pat. No. 3,636,653 discloses a doll with eyes which may be actuated by gravity, and also rods moved by a lever. The lever is moved by means operated by a cam extending from a shaft driven by a motorized music box mounted within the doll. The cam causes the eyes to blink.

U.S. Pat. Nos. 4,033,071 and 4,074,460 each disclose a doll having an operating mechanism actuated by a simulated bottle inserted in the doll's mouth to cause the doll to open and close its eyes and to simulate the action of sucking on the bottle. When placed in the doll's mouth, the bottle tip becomes mechanically connected to the operating mechanism so that rotation of the bottle will operate the mechanism.

U.S. Pat. No. 304,063 discloses a figure toy including apparatus for retaining the eyes alternatively in an open position or an eye closed position.

U.S. Pat. No. 3,699,707 discloses a doll with blinking eyelids moved by a pendulum. The doll has eyes that not only move from side to side, but which also blink rapidly, but occasionally, and close when the doll is laid horizontally. The doll includes an eyelid lever which can pivot up and down to cover and uncover the eyes, and a pendulum which swings laterally. The pendulum carries a resilient wire that can brush against a projection on the eyelid lever to quickly pivot it to cover the eyes, and then quickly release from it to allow the eyes to be uncovered. The eyelid lever is weighted so that the eyelids thereon cover the eyes when the doll is laid horizontally and face up.

DISCLOSURE OF THE INVENTION

In accordance with the present invention, a new and useful animated figure toy is provided with an improved eye-moving mechanism. This mechanism is employed in a figure toy having a pair of eyes, a pendulum pivotally mounted on the figure toy adjacent the eyes, a mechanism mounted on the figure toy including eyelids mounted for up and down movement about a horizontal axis for covering and uncovering the eyes and a device for coupling the pendulum to the mounted mechanism to blink the eyelids. In the improvement of the present invention, the coupling device comprises an apparatus for blinking the eyelids cyclically when the figure toy is swung to one side of a vertical center line.

The blinking apparatus may include a cam and a follower coupled to the cam. The cam is configured to drive the follower cyclically. The cam may comprise an M-shaped slot provided on the pendulum. The cam follower may comprise a finger having a first end carried by the mounted mechanism and a second end riding in the M-shaped slot.

BRIEF DESCRIPTION OF THE DRAWINGS

Details of the present invention will be described in connection with the accompanying drawings wherein:

FIG. 2 is an enlarged, partial cross-sectional view taken along line 2—2 of FIG. 1;

FIG. 4 is an enlarged, cross-sectional view taken along line 4—4 of FIG. 3.

BEST MODE FOR CARRYING OUT THE INVENTION

Figure 1:
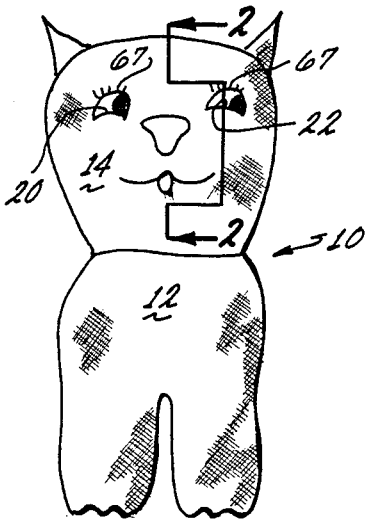
FIG. 1 is a front elevational view of an animated figure toy constituting a presently-preferred embodiment of the invention.

Referring again to the drawings, a figure toy constituting a presently-preferred embodiment of the invention, generally designated 10, includes a body 12 and a head 14. As may best be seen in FIG. 2, head 14 includes a feature-defining member 16 which may be made from a suitable soft material such as cloth or plastisol and which is affixed to an internal support member 18.

As best seen in FIG. 1, figure toy 10 also includes a pair of eye openings 20, 22, each of which extend through both the feature-defining member 16 and the internal support member 18, as shown in FIG. 2 for the opening 20.

Figure 3:
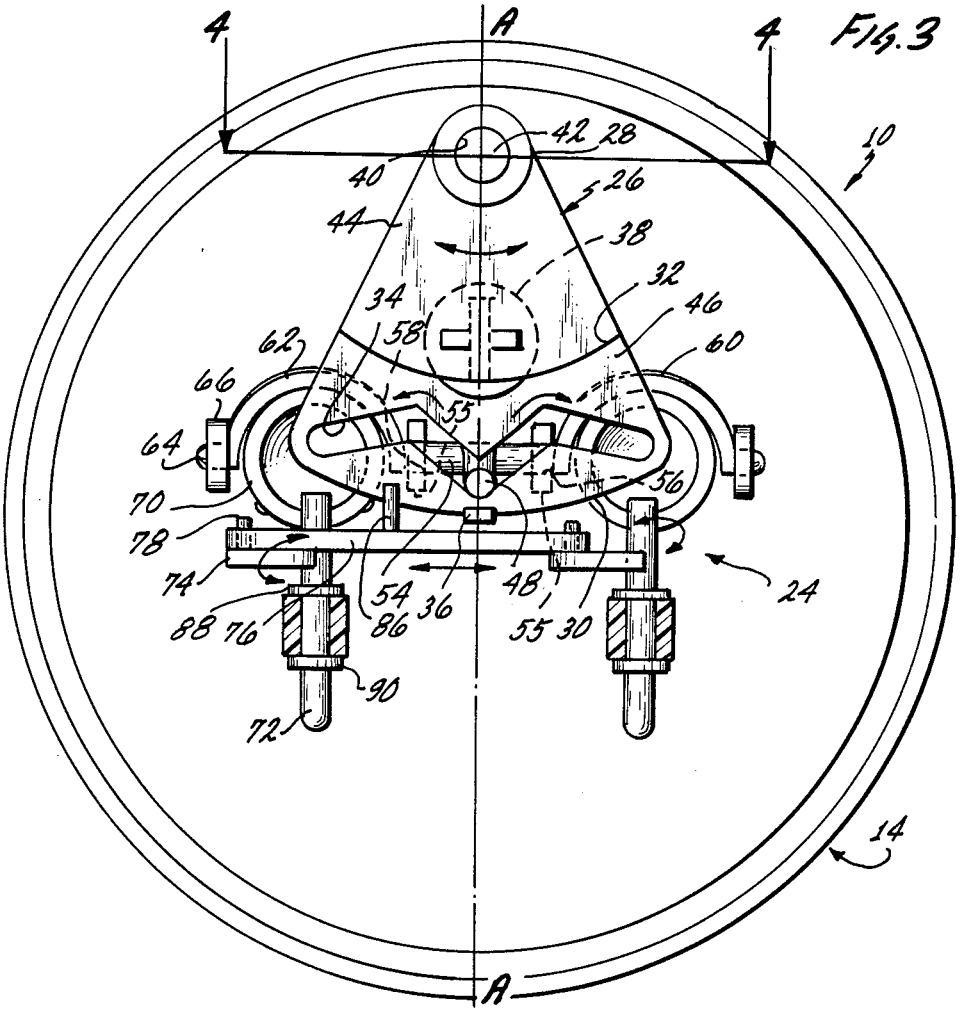
FIG. 3 is a rear elevational view of the mechanism of FIG. 2.

Referring now to FIGS. 2–4, figure toy 10 also includes an improved eye-moving mechanism 24 which is mounted to internal support member 18. This eye-moving mechanism 24 includes a pie-shaped pendulum 26 having an apex portion 28, a base portion 30 and an intermediate portion 32. Pendulum 26 is provided with an M-shaped cam 34, a protuberance 36, a counterweight 38 and an aperture 40. Aperture 40 is provided in apex portion 28 for swingably mounting pendulum 26 on a pivot pin 42 which is provided in the upper portion of internal support member 18 midway between eye openings 20, 22. Pendulum 26 is configured and dimensioned in a manner such that an upper area 44 (lying between intermediate portion 32 and apex 28) lies in a first vertical plane directly beneath apex 28 and a lower area 46 (lying between intermediate portion 32 and base 30) is offset toward eye openings 20, 22 and lies in a plane substantially parallel to the plane of the upper area 44. With this arrangement, the M-shaped cam 34 will lie directly behind eye openings 20, 22.

Eye-moving mechanism 24 also includes an elongated cam follower 48 having a first end 50 affixed to an eyelid link 54 and a second end 52 extending into operative engagement with cam 34. Eyelid link 54 is rotatably mounted in journal bearings 55 and includes ends 56, 58 to which eyelids 60, 62, respectively, are affixed. As shown in FIG. 3 for eyelid 62, each eyelid carries an outwardly-extending trunnion 64 rotatably mounted in a journal bearing 66 and, as is shown in FIG. 2 for eyelid 60, each is provided with an eyelash 67.

Figure toy 10 also includes a pair of eyeballs 68, 70, each of which is affixed to a spindle 72 rotatably mounted to internal support member 18, as shown in FIG. 2. Each spindle 72 carries a crank arm 74 to which a link 76 is connected by a pin 78 for synchronous movement of eyeballs 68, 70 from side to side.

Link 76 may be moved back and forth by protuberance 36 on pendulum 26 which is adapted to cyclically engage a pair of upstanding posts, like the one shown at 86 in FIG. 3, which are affixed to link 76 in the path of travel of protuberance 36. Each spindle 72 may be maintained at the proper elevation in support member 18 by a pair of disks 88, 90 affixed to spindle 72.

Internal support member 18 may be molded from a suitable polymeric material and comprises a front half 80 and rear half 82 which may be suitably joined together along a parting line 84.

Operation of eye-moving mechanism 24 is believed to be apparent from the foregoing and will be briefly summarized at this point. Referring now to FIG. 3, if figure toy 10 is tilted to the left with respect to its center line A—A, weight 38 will carry pendulum 26 to the left in a manner such that cam 34 will cause cam follower 48 to move up and down. As cam follower 48 moves up, it will close eyelids 60, 62 which will then open when cam follower 48 travels down. During this movement, protuberance 36 will engage upstanding post 86 and rotate spindle 72, thereby causing eyeballs 68, 70 to move to one side of eye openings 20, 22, respectively.

When figure toy 10 is then tilted to the other side of center line A—A, cam 34 will again cause eyelids 60, 62 to blink and protuberance 36 will engage the other upstanding post 86 to rotate eyeballs 68, 70 in the opposite direction.

While the particular animated figure toy herein shown and described in detail is fully capable of attaining the objects and providing the advantages hereinbefore stated, it is to be understood that it is merely illustrative of the presently-preferred embodiment of the invention and that no limitations are intended to the details of construction or design herein shown other than as defined in the appended claims.

We claim:

1. In combination with a figure toy including a head having eye openings provided therein, the improvement which comprises:

means mounting an eyeball in each of said openings for side-to-side movement with respect thereto;

means mounting an eyelid in each of said openings for at least partially covering and uncovering a respective one of said eyeballs;

means linking said eyelids together for concurrent eyeball covering and uncovering movements;

means linking said eyeballs together for concurrent side-to-side movements;

a pendulum, said pendulum being substantially pie-shaped and including an apex, a base and an intermediate portion, said intermediate portion lying between said apex and said base, said pendulum also including an area extending from said base to said intermediate portion which is offset from the portion of said pendulum which extends from said intermediate portion to said apex;

means rotatably connecting said apex to said head above and between said eye openings in a manner such that said offset area extends to a position directly behind said eyelid-linking means;

an M-shaped cam provided on said pendulum in said offset area;

an elongated cam follower having first and second ends, one of said first and second ends of said cam follower being affixed to said eyelid-linking means and the other of said first and second ends of said cam follower extending into operative engagement with said M-shaped cam, whereby oscillation of said pendulum moves said M-shaped cam in a manner such that said elongated cam follower is moved up and down causing said eyelids to blink;

a protuberance affixed to said base on said pendulum in alignment with said apex;

a post affixed to said eyeball-linking means adjacent each of said eyeballs, each of said posts lying in the path of travel of said protuberance, whereby oscillation of said pendulum will bring said protuberance into engagement with said posts for effectuating said side-to-side movement of said eyeballs; and a weight affixed to the intermediate portion of said pendulum in alignment with said apex and said protuberance for adding inertia to said pendulum.

* * * * *